US006837814B2

(12) United States Patent
Thomas

(10) Patent No.: US 6,837,814 B2
(45) Date of Patent: Jan. 4, 2005

(54) BALL

(75) Inventor: Andrew John Thomas, Prahran (AU)

(73) Assignee: Play Games Sport Pty. Ltd., Victoria (AU)

( * ) Notice: Subject to any disclaimer, the term of this patent is extended or adjusted under 35 U.S.C. 154(b) by 0 days.

(21) Appl. No.: 10/611,861

(22) Filed: Jul. 3, 2003

(65) Prior Publication Data

US 2004/0072639 A1 Apr. 15, 2004

Related U.S. Application Data

(63) Continuation of application No. 09/951,381, filed on Sep. 14, 2001, now abandoned, which is a continuation of application No. PCT/AU00/00185, filed on Mar. 14, 2000.

(30) Foreign Application Priority Data

Mar. 16, 1999 (AU) ..... PP9230

(51) Int. Cl.[7] ..... A63B 37/14
(52) U.S. Cl. ..... 473/613
(58) Field of Search ..... 473/600, 606, 473/613, 596, 597

(56) References Cited

U.S. PATENT DOCUMENTS

| | | | |
|---|---|---|---|
| 860,589 | A | 7/1907 | Wharton |
| 1,865,481 | A | 7/1932 | Penfold |
| 2,776,139 | A | 1/1957 | Blamey, Jr., et al. |
| 4,874,169 | A | 10/1989 | Litchfield |
| 5,280,906 | A | 1/1994 | Vitale |
| 5,893,808 | A | 4/1999 | Bennett |
| 6,261,197 | B1 | 7/2001 | Grechko |

OTHER PUBLICATIONS

Mehta, "An Overview of Cricket Ball Swing," submitted for publication in Sports Engineering Journal.
Mehta, "Cricket Ball Aerodynamics: Myth Versus Science," paper presented at the 3rd International Conference on The Engineering of Sport, Sydney, Australia, Jun. 9–12, 2000, sponsored by the International Sports Engineering Association (ISEA); also in "The Engineering of Sport, Research, Development and Innovation," (Eds. Subic et al.) (Oxford, UK; Blackwell Science, 2000), pp. 153–167.
Pallis et al., "Aerodynamics and hydrodynamics in sports," paper presented at the 4th International Conference on the Engineering of Sport, Kyoto, Japan, Sep. 3–6, 2002.
Mehta et al., "Tennis Ball Aerodynamics and Dynamics," Invited Chapter in Book: "Biomedical Engineering Principles in Sports" (Ed. Hung), Kluwer Academic/Plenum Publishers, MA, 2003.

(List continued on next page.)

*Primary Examiner*—Steven Wong
(74) *Attorney, Agent, or Firm*—Finnegan, Henderson, Farabow, Garrett & Dunner, LLP

(57) ABSTRACT

A ball for use in sport or recreation to be delivered through air comprises a smooth portion having a relatively smooth surface on one side of the ball, and a rough portion having a relatively rough surface on an opposite side of the ball. The smooth portion may comprise greater than 50% of the surface of ball. For example, the smooth portion may comprise between 55% and 75% of the surface of the ball. The ball also may comprise a seam located entirely on the smooth portion. The seam may include a plurality of rows of imitation stitches on the surface of the smooth portion. When delivered through the air, the ball may deviate from an expected trajectory towards the side of the ball having the smooth surface.

17 Claims, 1 Drawing Sheet

OTHER PUBLICATIONS

Pallis et al., "Chapter 6: Balls and Ballistics," Invited Chapter for Book: Materials in Sports, Woodhead Publishing Ltd., England, 2003.

Mehta, et al., "Sports Ball Aerodynamics: Effects of Velocity, Spin and Surface Roughness," Keynote Paper presented at the Materials and Science in Sports Conference, Apr. 22, 25, 2001, Coronado, CA.

Pallis et al., "Tennis Science Collaboration Between NASA and Cislunar Aerospace," Paper presented at the 1st International Congress on Tennis Science and Technology, London, England, Aug. 1–4, 2000, sponsored by the International Tennis Federation (ITF), Blackwell Science, Oxford, UK, pp. 135–144.

Mehta et al., "The Aerodynamics of a Tennis Ball," Sports Engineering, vol. 4, Issue 4, pp. 177–189, Nov. 2001.

Mehta et al., "Aerodynamics of the cricket ball," New Scientist, vol. 87, No. 1213, Aug. 7, 1980.

Mehta, "Aerodynamics of Sports Balls," Ann. Rev. Fluid Mech., 17:151–189, 1985.

Mehta, "Flying objects get a good airing," Physics World, vol. 10, No. 10, pp. 52–53, Oct. 1997.

Bown et al., "What makes a ball swing?," Independent on Sunday, Newspaper, London, England, pp. 19, Aug. 7, 1994.

Bown et al., "The seamy side of swing bowling," New Scientist, vol. 139, No. 1887, pp. 21–24, Aug. 21, 1993.

Articles from Indian Newspapers: "NASA to help TCCB counter ball–tampering," and "Scientist joins ball–tampering controversy," Aug. 1994.

Articles from The Independent Newspaper, "NASA on the ball," and "English board turn to NASA expert," Aug. 1994.

Article from the Sunday Times, London, Aug. 7, 1994, "Scientist helps in cricket controversy".

Bown, "NASA man called in over ball–tampering," Article from the Independent on Sunday, No. 236, Aug. 7, 1994.

Article from Review, "The secrets of swing," Jul. 30, 1994.

Mehta et al., "Factors Affecting Cricket Ball Swing," Nature, vol. 303, pp. 787–788, Jun. 30, 1983.

Article from The Times, London, Jul. 1, 1983, "Cricket ball secrets tumble".

Article from New Scientist, "Why balls swing," Jul. 14, 1983.

Article from Nature, "Not as it seams!," Sep. 1983.

Article from Daily Mail, "Secret of Swing Bowling Is Not All It Seams," Jul. 2, 1983.

Mehta et al., "Balls in Flight A Mystery Explained," Science Now, vol. 1, Part 1, pp. 10–13, 1983.

Bentley et al., "An Experimental Study of Cricket Ball Swing," Department of Aeronautics, Aero Technical Note, 82–106, Imperial College, London, 1982.

Mehta, "A Review of the Theory of Boomerangs," Final Year Undergraduate Project Report, Aeronautical Engineering Department, Queen Mary College, University of London, 1975.

BALL

This application is a continuation of U.S. application Ser. No. 09/951,381, filed Sep. 14, 2001, now abandoned, which is a continuation of international application number PCT/AU00/00185, filed Mar. 14, 2000, which claims the priority of Australian Patent Application No. PP 9230, filed Mar. 16, 1999, the content of both of which are incorporated herein by reference.

BACKGROUND OF THE INVENTION

Bat and ball sports of the foregoing kind generally involve a contest between the batter and the ball deliverer, with the general object of the ball deliverer being to deliver the ball in such a manner that the batter misses or mishits the ball. One method used to frustrate the batter is to curve or swing the ball during flight from the ball deliverer to the batter. An experienced baseball pitcher can make a baseball curve towards or away from a batter provided the ball is pitched, with sufficient speed and horizontal rotation. For example, a ball pitched at 115 kilometers per hour rotating horizontally at 1800 rpm should move about 0.5 meters from a straight path between the pitcher's mound and the batting plate. Similarly, an experienced cricket bowler bowling a ball between 105 and 120 kilometers per hour with its seam angle between 15° to 40° to the direction of travel having the shinier of the two halves of the cricket ball presenting a leading face, while rotating about its seam, will swing towards the rougher side. Quite naturally, combining these requirements with the general requirement of pitching the ball to pass over the batting plate, or bowling the ball at the cricket stumps, is beyond the average player.

Whilst the specifications of a baseball/cricket ball are set according to the rules of the sport, there are situations, such as in practice or a social game, where a strict adherence is not mandatory. It would be advantageous in these situations to provide a ball Which facilitated a pitcher/bowler to curve/swing the ball.

SUMMARY OF INVENTION

According to the invention there is provided a ball for use in sport or recreation to be delivered through air, the ball is manufactured to include a smooth portion on one side of the ball having a relatively smooth surface, and a rough portion on the opposite side of the ball having a relatively rough surface, the smooth portion covering between 55 and 75% of the surface of the ball, a seam located entirely on the smooth portion which seam includes a plurality of rows of imitation stitches extending proud of the surface of the smooth portion, wherein when the ball is delivered through the air the ball deviates from an expected trajectory towards the side having the smooth surface.

It is preferred that the ball include a core with the smooth portion and rough portion attached to the core by attaching means. It is preferred that the attaching means be a flexible adhesive solution. The core may be hollow or solid and formed from an elastomer, polyurethane or cork.

It is further preferred that the smooth portion covers between 55% of the surface of the ball.

It is further preferred that the smooth surface of the smooth portion be formed from a different material than the rough surface of the rough portion. It is preferred that the smooth surface be formed from an elastomer or synthetic material whilst the rough surface be formed from nap or felt.

Alternatively, the smooth surface of the smooth portion and the rough surface of the rough portion may be formed from the same material, that preferred material being polyurethane. In this preferred embodiment the rough portion preferably includes a plurality of dimples located over the rough surface, wherein the size of the dimples range between 4 to 10 mm in diameter and 2 to 7.5 mm in depth.

In cricket, swinging the ball towards the shiny, smooth surface is called reverse swing. Generally for reverse swing to be achievable the required ball is a cricket ball of the first class variety i.e. a ball with a thin, extra seam running across each hemisphere at right angles to the main seam. The ball must be worn, and delivered at speeds really only obtainable by the elite, professional bowler. This explains why only a couple of dozen players in the history of the game have ever been able to do it consistently. The invention enables reverse swing to be achieved at speeds well within the reach of the average social participant at around 50 kilometers an hour and lower. Furthermore it is unnecessary to alter the ball in play, as had previously been required for reverse swing to be achieved.

Terms such as rough and smooth must be interpreted in the context of the invention as described in the specification. More specifically, regard is to be had to the effect the surface of the ball has on the flow of air when interpreting the terms rough and smooth.

It will be convenient to hereinafter describe the invention in greater detail by reference to the accompanying drawings which illustrate five example embodiments of the invention. The particularity of these drawings and the related description is not to be understood as superseding the generality of the broad identification of the invention as given in the preceding part of this specification.

BRIEF DESCRIPTION OF THE INVENTION

DETAILED DESCRIPTION OF PREFERRED EMBODIMENTS

Figure 1:
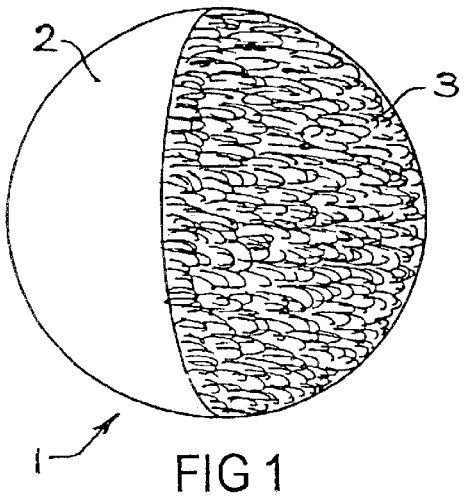
FIG. 1 is an illustration in diagrammatic form of a ball according to an embodiment of this invention.

FIG. 1 shows an example embodiment of a ball 1 according to the invention. The ball 1 includes a core (not shown) which is preferably hollow but may alternatively be solid. The core is spherical and preferably formed from an elastomer. The elastomer can be any suitable composition, however, it would be advantageous for the composition to facilitate the ball mimicking the weight and rebound characteristics of a genuine baseball/cricket/tennis ball. In particular it has been found advantageous that the ball be well balanced in terms of weight. Referring still to FIG. 1, the outer surface of the ball 1 includes a relatively smooth portion 2 on one side of the ball 1, and a relatively rough portion 3 on the opposite side of the ball 1. It is preferred, but not essential, that the two portions 2 and 3 are of substantially the same size (in terms of area), and each may form approximately 50% of the outer surface of the ball 1. Alternatively either portions 2, 3 may cover between 25% to 75% of the ball 1, with ratios of 55/45 to 65/35 being found most suitable.

Either one or both of the portions 2 and 3 may be formed separate from the core, and any such separately formed portion may be attached to the core using a flexible adhesive solution or any other suitable attaching means. The smooth portion 2 should be relatively smooth and the rough portion 3 be relatively rough so that relatively different fluid flow characteristics will develop across the two surfaces when the ball is delivered through air causing the ball to deviate from an expected straight or normal trajectory in a direction of the smooth portion.

The smooth portion 2 and rough portion 3 may be formed from any suitable material. It is preferred that the smooth portion 2 be formed from a composition including 48.9% natural rubber, 40.8% calcium, 1.6% esteric, 2.9% DP oil, 2.4% zinc powder, 0.9% sulfur, 0.9% MBT, 1.6% white factor. These components are mixed, cut into squares measuring approximately 4 cm×4 cm×0.8 cm, placed into a mould of specific design and pressed into a hollow semi-spherical shape. At the completed stage the smooth portion 2 can be covered on its external surface with any suitable substance such as silicon, but this is not essential.

Figure 2:
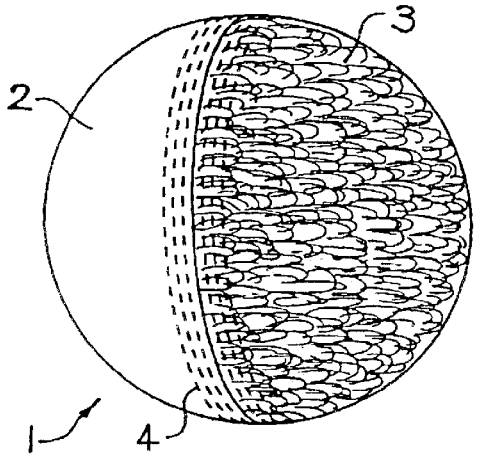
FIG. 2 is an illustration in diagrammatic form of the ball from FIG. 1 including a straight seam.
Figure 3:
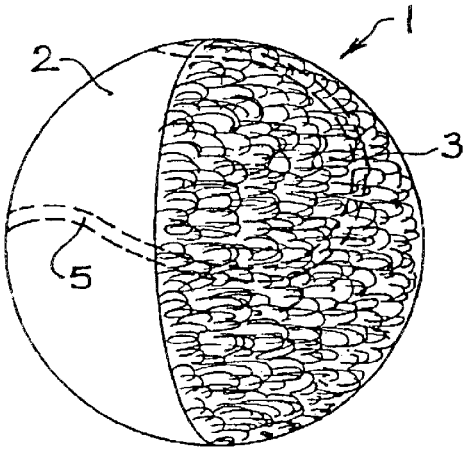
FIG. 3 is an illustration in diagrammatic form of the ball from FIG. 1 including a curved Yin/Yan type seam.

In the embodiment illustrated in FIGS. 1 to 3, the rough portion 3 is formed by tennis ball nap or felt which is formed by known processes. The production of the tennis ball nap does not form part of the invention.

FIG. 2 shows another example embodiment of the ball 1 which includes a straight seam 4 similar to the type of stitched seam used on a leather cricket ball. The straight seam 4 may be proud of the surface of the ball 1 or be flush with the surface of the ball 1. The seam 4 will preferably include three rows of imitation stitches on either side of the ball 1, but may be applied to one side only. It should be appreciated that the seam 4 may not necessarily be in the form of three rows of stitches on either portion but rather may have all stitches on one portion. Inclusion of the seam 4 may require the smooth portion 2 to cover up to 65% of the surface of the ball, but this is not essential.

FIG. 3 shows a further example embodiment of the ball 1 which includes a curved seam 5 similar to the Yin and Yan type seam used on tennis balls and baseballs. The curved seam 5 may be proud of the surface flush with the surface of the ball 1 and applied to one or both portions of the ball.

Whilst not illustrated it should be appreciated that the ball may include a combination of the features shown in FIGS. 2 and 3. More specifically, the ball may include the combination of a cricket ball seam with the Yin and Yan type seams.

Figure 4:
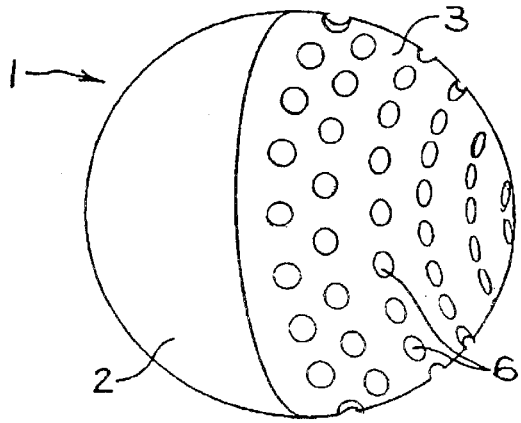
FIG. 4 is an illustration in diagrammatic form of a ball according to a second embodiment of this invention.

In the embodiment illustrated in FIG. 4 the rough portion 3 is formed from a material substantially identical to the smooth portion 2 previously described with the addition of dimples 6. The dimples 6 may be of any shape or configuration, however, dimples ranging from 4 mm to 10 mm in diameter and 2 mm to 7.5 mm in depth have been found suitable. It is not essential that the dimples be round or concave but rather they may be any other shape such as for example, hexagonal or convex. This embodiment may also include some of the features from FIGS. 2 and 3, namely the straight seam 4 or Yin and Yan type seam 5 or a combination of the both.

Figure 5:
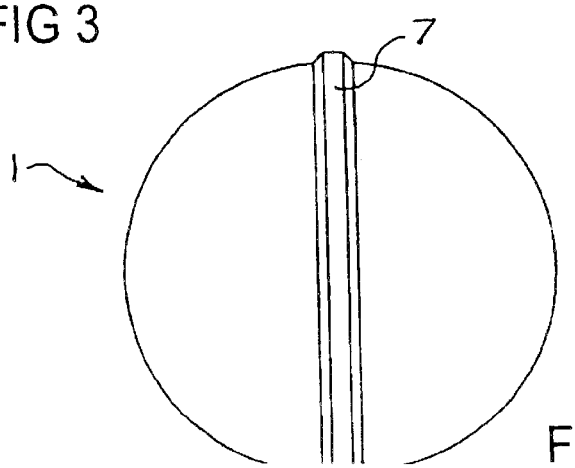
FIG. 5 is an illustration in diagrammatic form of the ball from FIG. 1 including a circumferentially extending raised keel.

The embodiment illustrated in FIG. 5 is of the ball 1 including a raised keel 7. The raised keel 7 extends proud of the remainder of the surface of the ball 1. The raised keel 7 facilitates retention of the ball 1 rotating about an axis perpendicular to the keel 7. This will in turn facilitate delivering the ball 1 in a suitable manner for it to deviate from the expected trajectory. The keel 7 can be used in conjunction with elastomer/nap ball embodiment from FIGS. 1 to 3 or dimpled ball embodiment from FIG. 4.

Finally, it is to be understood that various alterations, modifications and/or additions may be introduced into the construction and arrangement of the parts previously described without departing from the spirit or ambit of the invention.

What is claimed is:

1. A ball for use in sport or recreation to be delivered through air, the ball includes:

a smooth portion on one side of the ball having a relatively smooth surface, the smooth portion covering greater than 50% of the surface of the ball, a rough portion on the opposite side of the ball having a relatively rough surface, and a seam located entirely on the smooth portion, the seam including a plurality of rows of imitation stitches on the surface of the smooth portion, wherein when the ball is delivered through the air the ball deviates from an expected trajectory towards the side having the smooth surface.

2. A ball according to claim 1 shaving a core with the smooth portion and rough portion attached to the core by attaching means.

3. A ball according to claim 2 wherein the core is elastomer.

4. A ball according to claim 2 wherein the core is polyurethane.

5. A ball according to claim 2 wherein the core is cork.

6. A ball according to claim 2 wherein the core is hollow.

7. A ball according to claim 2 wherein the core is solid.

8. A ball according to claim 2 wherein the attaching means is a flexible adhesive solution.

9. A ball according to claim 1 wherein the smooth portion covers 55% of the surface of the ball.

10. A ball according to claim 1 wherein the smooth surface of the smooth portion is of a different material than the rough surface of the rough portion.

11. A ball according to claim 1 wherein the smooth surface is selected from at least one of an elastomer and synthetic material.

12. A ball according to claim 1 wherein the rough surface is selected from at least one of nap and felt.

13. A ball according to claim 1 wherein the smooth surface of the smooth portion and the rough surface of the rough portion are of the same material.

14. A ball according to claim 13 wherein the material is selected from at least one of an elastomer, synthetic polyurethane and leather.

15. A ball according to claim 13 wherein the rough portion includes a plurality of dimples located across the rough surface.

16. A ball according to claim 15 wherein the size of the dimples range between 4 to 10 mm in diameter and 2 to 7.5 mm in depth.

17. A ball according to claim 1 wherein the smooth portion covers a portion of the surface of the ball ranging from 55% to 75% of the surface of the ball.

* * * * *

UNITED STATES PATENT AND TRADEMARK OFFICE

CERTIFICATE OF CORRECTION

PATENT NO. : 6,837,814 B2
DATED : January 4, 2005
INVENTOR(S) : Andrew John Thomas It is certified that error appears in the above-identified patent and that said Letters Patent is hereby corrected as shown below:

Column 4,
Line 26, change “shaving” to -- having --.

Signed and Sealed this

Nineteenth Day of April, 2005

JON W. DUDAS
*Director of the United States Patent and Trademark Office*